United States Patent [19]

Schlueter et al.

[11] 4,079,571

[45] Mar. 21, 1978

[54] PACKAGE FORMING MACHINE

[75] Inventors: David Frederick Schlueter; Lonnie Ray Seymour, both of Hoopeston, Ill.

[73] Assignee: Illinois Tool Works Inc., Chicago, Ill.

[21] Appl. No.: 747,751

[22] Filed: Dec. 6, 1976

Related U.S. Application Data

[63] Continuation-in-part of Ser. No. 666,738, Mar. 15, 1976, abandoned.

[51] Int. Cl.[2] ..... B65B 27/04; B65B 13/04

[52] U.S. Cl. ..... 53/48; 53/196; 198/419; 198/732

[58] Field of Search ..... 53/48, 159, 196, 198 R; 198/419, 420, 732, 792

[56] References Cited

U.S. PATENT DOCUMENTS

| | | | |
|---|---|---|---|
| 1,116,406 | 11/1914 | Fleischer | 198/732 |
| 3,007,293 | 11/1961 | McGihon | 53/48 X |
| 3,032,943 | 5/1962 | Reimers et al. | 53/48 |
| 3,194,382 | 7/1965 | Nigrelli et al. | 198/419 |
| 3,845,852 | 11/1974 | Langen et al. | 198/732 |
| 3,959,949 | 6/1976 | Benno et al. | 53/35 |

*Primary Examiner*—Robert Louis Spruill

*Attorney, Agent, or Firm*—Edward L. Benno; Robert W. Beart

[57] ABSTRACT

A container control mechanism for use in certain types of package forming machines which produce packages of a plurality of containers. The certain package forming machines are those where three or more rows of containers are continuously delivered through the machine, and in which the machine applies a strip of carrier stock circumferentially about the upper end of each of the containers. The containers in rank and file with the applied carrier stock are delivered to a cutting mechanism adjacent the output end of the machine where the stock is severed between certain predetermined ranks to form individual packages of a predetermined plurality of ranks of the containers. The container control mechanism controls the file or files of containers between the outboard files of the containers in the area of the strip stock application as the containers are carried on the horizontal machine conveyors and essentially serves to direct and to momentarily increase the speed of the moving containers relative to the moving strip stock to urge the leading edge of the containers into the leading edge of the container receiving apertures of the strip stock.

3 Claims, 14 Drawing Figures

PACKAGE FORMING MACHINE

BACKGROUND OF THE INVENTION

The subject application is a Continuation-in-Part application of the co-pending prior application of the same inventors filed Mar. 15, 1976, Ser. No. 666,738, now abandoned.

The control mechanism of the subject invention cooperates with a system, machine and method for multipackaging containers as shown and described in the U.S. Pat. No. 3,959,949 of Benno et al, issued June 1, 1976. The system, machine and method for multipackaging containers of that patent is different from prior art teachings in its teachings of the application of a strip of carrier stock to more than two adjacent rows of containers moving substantially continuously through an application station.

A further United States patent which is related to the Benno et al patent and this application is the U.S. Pat. No. 3,991,640 of Schlueter, issued Nov. 16, 1976. The Schlueter patent teaches a mechanism for severing a strip of carrier stock applied to ranks and files of containers in which the files of containers are more than two in number to form individual packages of a predetermined number of ranks of the containers.

Control mechanisms for directing containers in carrier stock applicating machines of prior known systems, machines and methods teach various arrangements which will only control and direct two rows of containers. Such container control mechanisms are shown, for example, in U.S. Pat. Nos. 3,032,943, 3,032,944, 3,330,402 and 3,383,828. As may be seen in those patents, the outer surfaces of the containers in two rows of containers are conveniently available for use and cooperation with container directing and control mechanisms which operate in cooperation with carrier stock applicating mechanisms to direct the containers into association with the carrier stock.

SUMMARY OF THE INVENTION

The basic mechanism of the subject invention uniquely solves the problem of control and direction of a row or rows of containers which are between the outside rows of containers continuously moving at relatively high speed on horizontal conveyors through carrier applicating machines where the carrier is a strip of carrier stock continuously delivered and applied to more than two moving rows of containers.

Briefly, the invention involves a continuous chain mounted in a multipackaging machine of the type noted above and positioned below the horizontal conveyors which carry the containers and below the row of containers which is between the two outboard rows of containers. The chain carries a plurality of container guide brackets. The container guide brackets each have a projecting post or finger and a cam roller. The upper flight of the chain is supported on a chain guide frame which is formed so that the upper flight in progressing thereover is firstly directed substantially horizontally beneath the middle row of moving containers for a certain distance and then is moved at an angle downwardly and forwardly from the line of movement of the containers. The post or finger carried by each of the brackets on the chain projects upwardly from the upper flight of the chain and between adjacent flights of the horizontal container conveyors to engage a rearward side of one of the moving containers, and because of the forward and downward change in direction of the upper flight of the moving chain, the horizontal spacing between the fingers is reduced over the area of the upper flight where the chain is moving downwardly and forwardly. Since the chain itself is moving at one linear speed, the horizontal component of movement of the fingers over the area of the chain where the chain is moving forwardly and downwardly results in the containers being moved at a slower horizontal speed over that portion of the movement of the upper chain flight than over the area of the upper chain flight where the chain is moving in a substantially horizontal direction. The carrier stock is in an applied condition to the containers immediately after the change in direction of the upper chain flight. Thus, after the carrier stock is applied, the fingers release their forward horizontal thrust on the center file of containers. When not under control of the fingers, the horizontal container carrying conveyors generally move the containers at a speed substantially equal to or slightly slower than the movement of the upper chain flight when it is horizontally directed. After the carrier stock is applied, the container carrying conveyors are moving faster than the fingers.

The container control and directing fingers in moving are further caused to pivot in a vertical plane including the fingers by the cam rollers on each finger supporting bracket rolling in a cam guide having a cam track configuration which is different from that of the chain guide for the upper flight of the chain. The different configuration of the cam guide track is such that immediately before the leading edge of the containers is to engage the bands of the carrier stock, the fingers are pivoted slightly rearwardly to effect what amounts to a slight retardation of the container movement. Immediately thereafter the cam guide track causes the finger brackets to pivot the fingers in a forward direction to effect a momentary speedup in the forward movement of the fingers to accelerate the leading edge of each container at that point into the leading edge of each center band of the carrier stock.

The primary object of the present invention is to provide in a carrier stock applicating machine which includes a horizontal conveyor continuously moving more than two rows of containers through the machine for continuous application of carrier stock to the containers, a container control and direction mechanism for the row or rows of containers on the conveyor which are between the outside rows of containers to control and direct the center file or files of containers into positive engagement with the carrier stock bands for proper application of the carrier stock to the containers.

Other objects and features of the invention will be apparent upon a perusal of the hereinafter following detailed description read in conjunction with the drawings.

DETAILED DESCRIPTION OF THE PREFERRED EMBODIMENT

Figure 2:
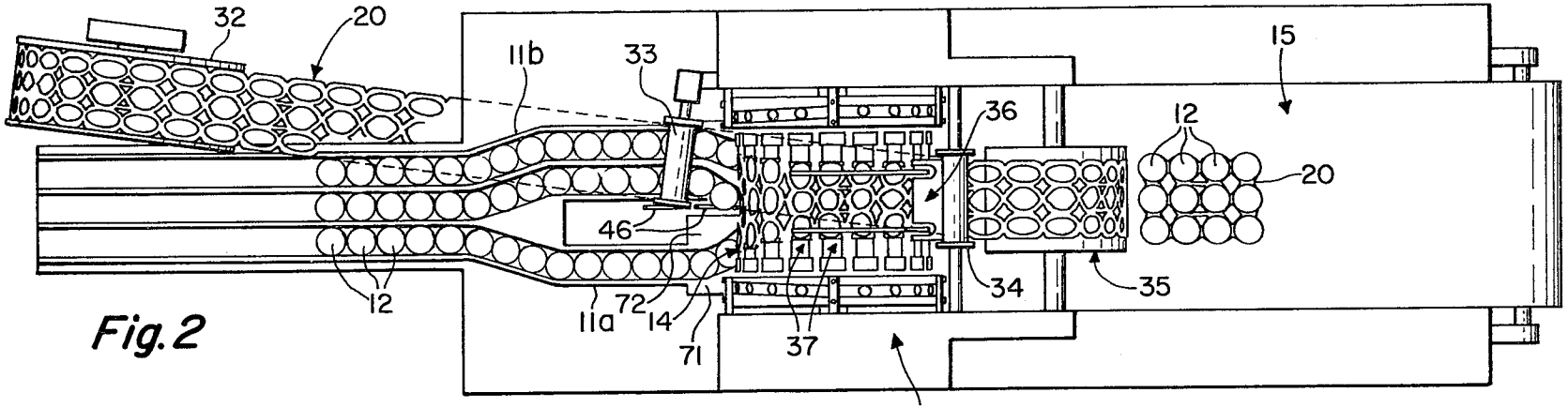
FIG. 2 is a top plan view of the machine of FIG. 1.
Figure 1:
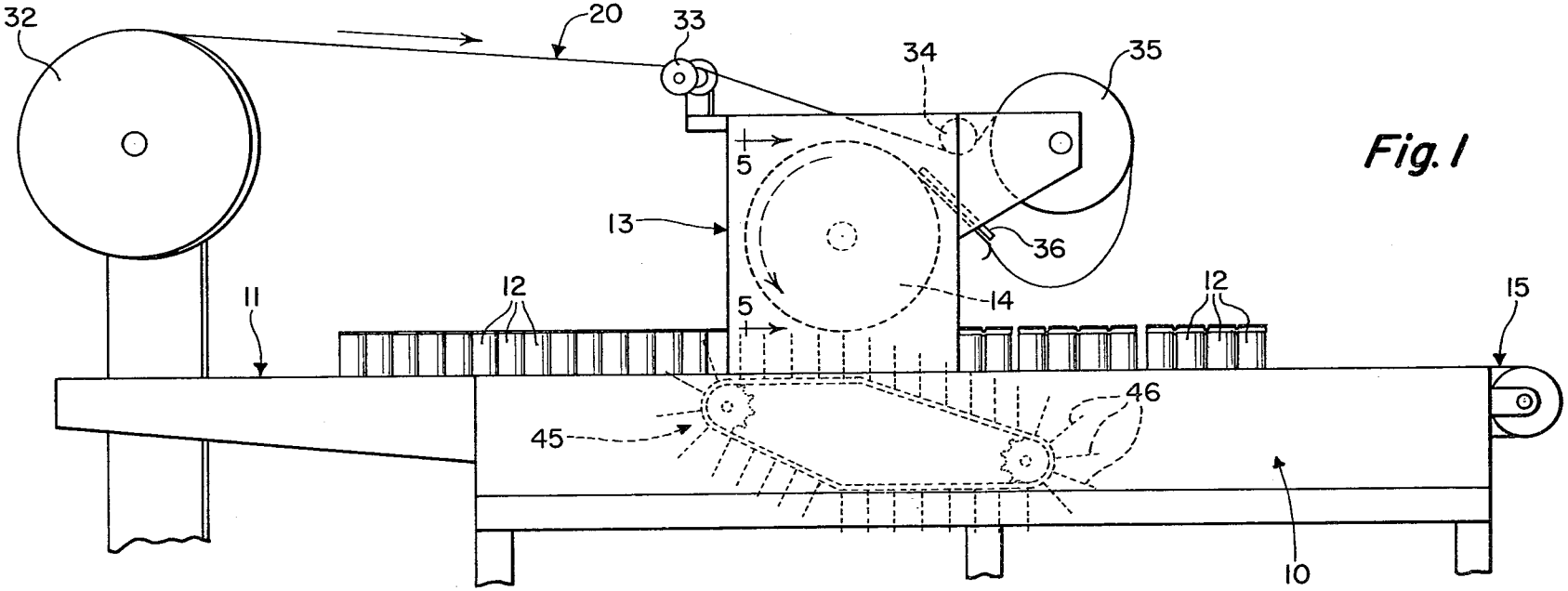
FIG. 1 is a side elevational view of one embodiment of an applicating machine embodying the subject invention.

The total machine as shown in FIGS. 1 and 2 is substantially exemplary in form and many of the parts, which are not critical to an understanding of the subject invention and for which known parts may be used are only briefly shown. Further, reference to the U.S. Pat. No. 3,959,949 of Benno et al, and the U.S. Pat. No. 3,991,640 of Schlueter, will aid those skilled in the art in an understanding of the total machine.

Figure 7:
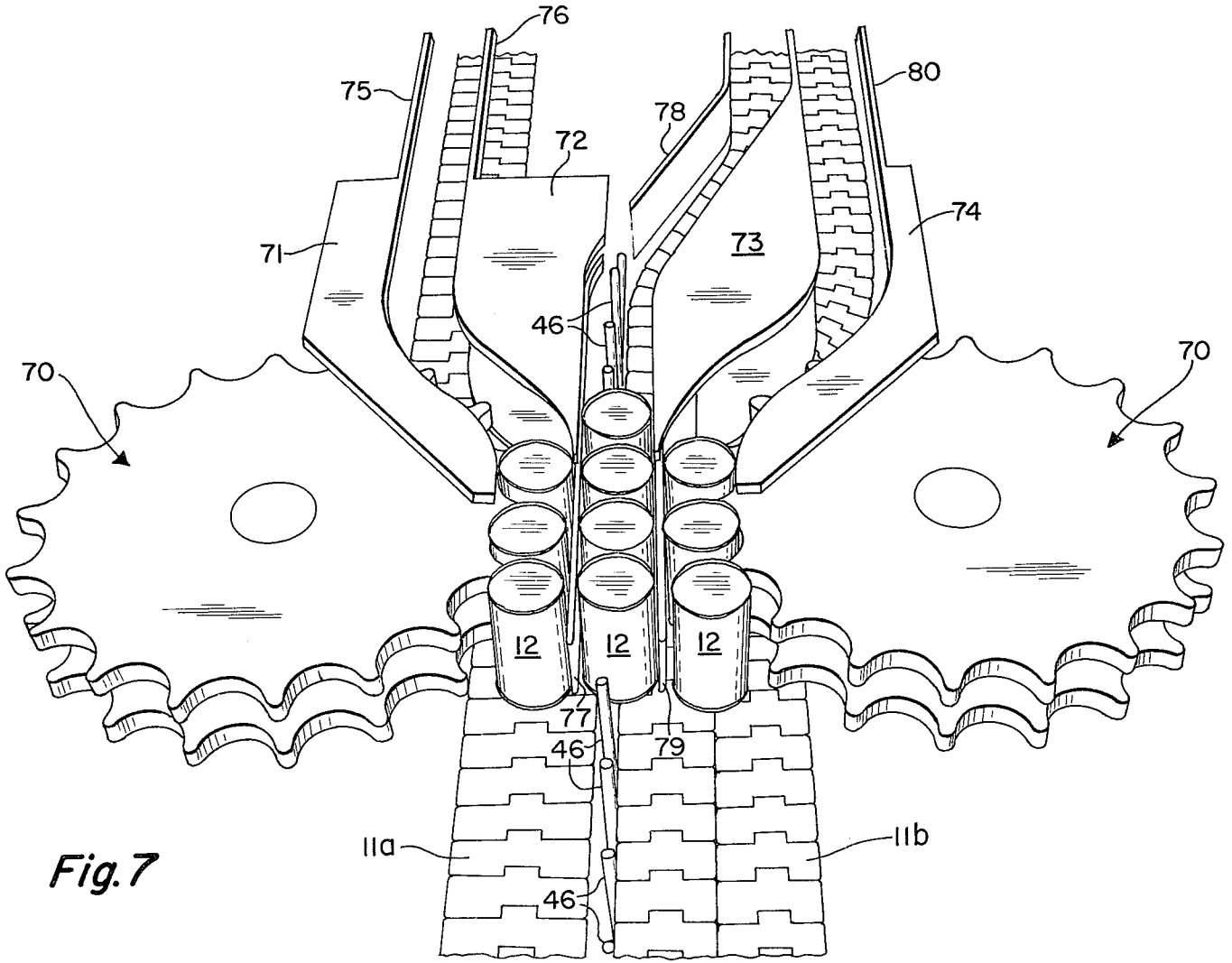
FIG. 7 is an enlarged isometric view of the area of the machine below the carrier stock applicating mechanism when viewed from the outlet end of the machine.

The machine comprises a base 10 which may be constructed in any suitable known manner for supporting the operating elements of the machine, and an input conveyor 11 of any suitable type is provided for delivering at least three adjacent rows of containers such as cans 12 to and through the work station 13 of the machine. In order to provide clearance for the control mechanism for the center file of containers, the conveyor 11 is split into a portion 11*a* and a portion 11*b* as shown in FIGS. 2 and 7. The split portions 11*a* and 11*b* are transversely spaced-apart at the input section of the work station 13 of the machine to enable the fingers 46 of the center file can control mechanism 45 shown in dotted lines in FIG. 1 to clear the containers 12 entering the work station 13 and to achieve interposition with the center file of containers 12 in the work station 13. The work station 13 comprises a drum assembly 14 mounted therein immediately above the three rows of cans 12 passing through the work station 13. The drum assembly 14 is further carried to rotate about a horizontal axis transversely above the three rows of cans 12. The machine further includes a suitable output conveyor 15 for receiving the three rows of cans 12 from the work station 13 with the carrier stock 20 applied thereto.

Figure 3:
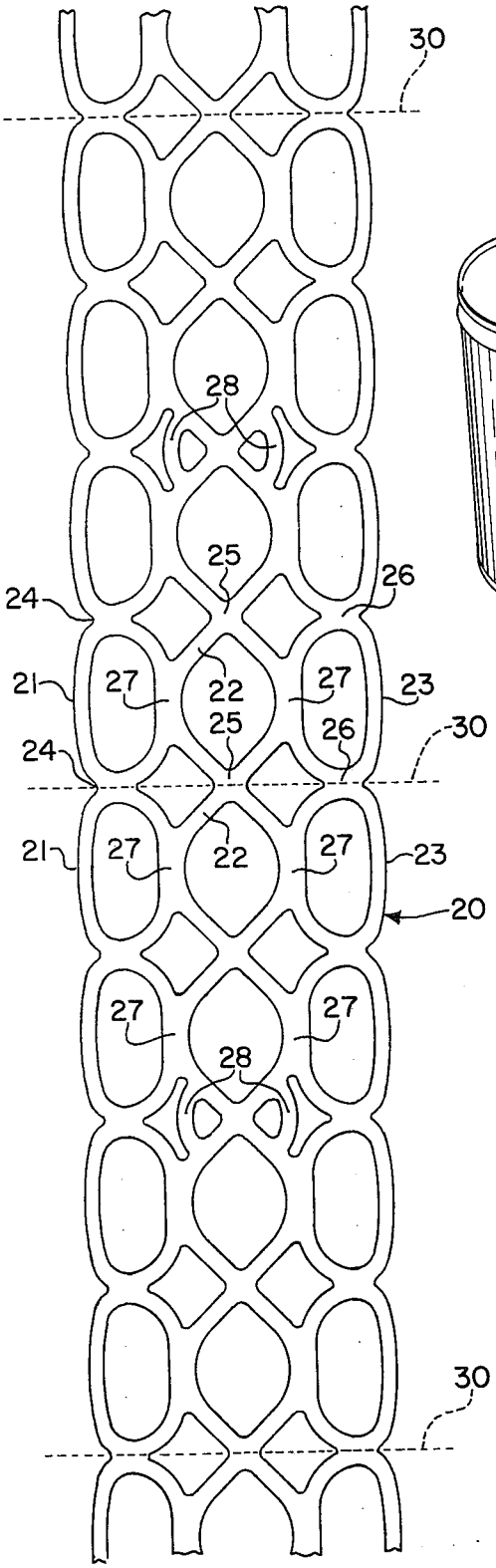
FIG. 3 is a plan view of one embodiment of a multipackaging carrier stock which may be used in applicating machines including the subject invention.

One form of multipackaging strip or stock that is applied to the cans 12 by the applicating machine is shown in FIG. 3. That multipackaging strip, and other embodiments thereof, is shown and described in detail in the co-pending U.S. application of Mindaugas Julius Klygis, Ser. No. 581,591, filed May 29, 1975 now U.S. Pat. No. 4,018,331. The multipackaging strip 20 is made from a resilient plastic or plastics materials, such as low density polyethylene. The strip 20 comprises, in the embodiment shown in FIG. 3, three rows or files of bands 21, 22 and 23. The rows of bands 21 are integrally interconnected by webs 24. The row of bands 22 are integrally interconnected by webs 25, and the row of bands 23 are integrally interconnected by webs 26. The three rows or files of bands 21, 22 and 23 are further integrally interconnected in a side-by-side arrangement of ranks by webs 27 with the row of bands 22 being disposed between the two side or outboard rows of bands 21 and 23.

Figure 4:
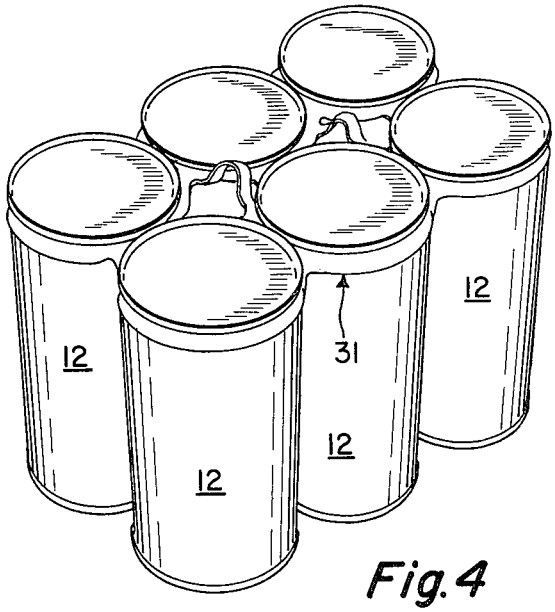
FIG. 4 is an isometric view of a multipackage of containers such as may be produced in applicating machines including the subject invention.

Straps or handle elements 28 are provided between two adjacent bands 22 in a certain pattern that may be seen in FIG. 3. The straps 28 are located between every fourth pair of center bands 22. It thus may be seen that if the carrier strip or stock 20 is transversely severed through the webs 24, 25 and 26 along the lines 30 shown in FIG. 3 individual carriers for 12 cans 12 will be formed. With other locations of the strap elements 28, and with appropriate transverse severance of the carrier stock having such other strap locations, multipackages of other than 12 cans 12 may be produced. FIG. 4 shows a modified strip 31 on six cans 12 to produce a multipackage of six containers. Reference is made to the noted patent application of Mr. Klygis for a detailed understanding of various other embodiments of the carrier strip or stock 20.

Figure 5:
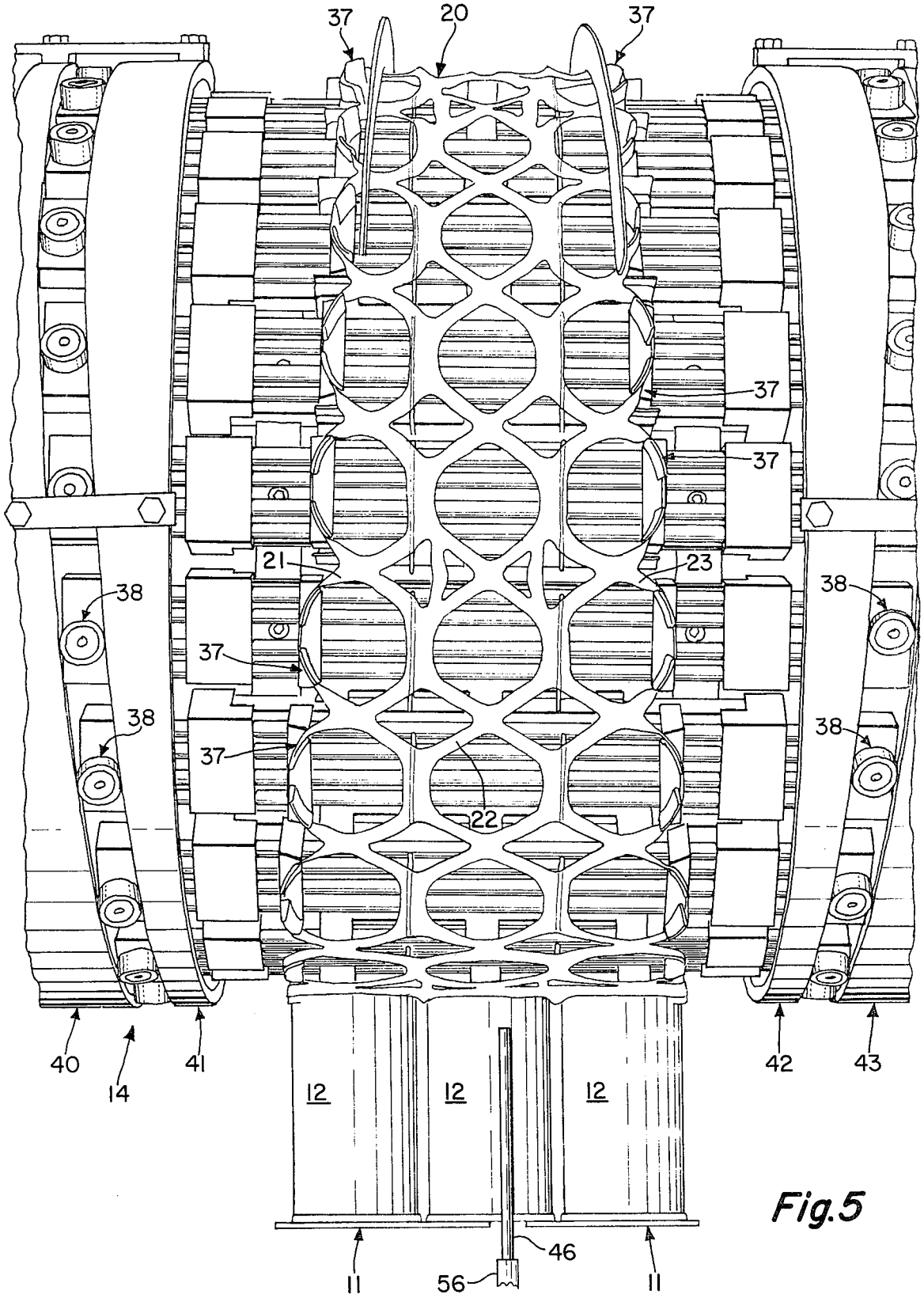
FIG. 5 is an enlarged side elevational view of a portion of the machine shown in FIG. 1 and taken substantially along the line 5 — 5 of FIG. 1.

Reference is further made to the noted patent of Benno et al for a detailed understanding of the manner in which the machine of FIGS. 1 and 2 operates to apply the carrier stock 20 to the three files of cans 12. Briefly, those skilled in the art will understand that the carrier stock 20 is taken from a reel 32 directed over and about appropriate guiding and indexing rollers, such as rollers 33, 34 and 35, to and into a carrier stock guide system 36. From the guide system 36, the carrier stock 20 is directed onto the jaw assemblies 37 of the drum assembly 14 in the work station 13. The jaw assemblies 37 are shown in substantial detail in FIG. 5, and each jaw assembly includes a pair of opposed jaws which are moved toward and away from each other by cam rollers 38 which roll within the cam rings 40, 41, 42 and 43 as the drum assembly 14 is rotated about the central horizontal axis aligned transversely of the machine. The view of the drum assembly 14 in FIG. 5 is such that the carrier 20 is moving downwardly and inwardly of the drawing and over the cans 12. As the drum assembly 14 rotates, the three rows of bands 21, 22 and 23 are stretched substantially as shown in FIG. 5 for application to the cans 12. While the drum assembly 14 is rotated, the three rows of cans 12 are carried by the conveyor 11 beneath the drum assembly 14 in a timed relationship thereto, so that the stretched carrier stock 20 is applied to the cans 12 with each band 21, 22 and 23 encircling one of the cans 12 immediately below the upper edge or chime thereof. As the cans 12 move from beneath the rotating drum assembly 14, the jaw assemblies 37 are drawn from the applied carrier stock 12, and the three rows of cans 12 proceed in a continuous arrangement to a cutting mechanism such as that shown and described in the Schlueter U.S. Pat. No. 3,991,640.

To aid in the high speed application of the carrier 20 to the cans 12, two arrangements are contemplated for appropriately synchronizing and accurately directing the cans 12 and the bands 21, 22 and 23 of the carrier stock 20 into applicating relationship. The first arrangement for the outboard bands 21 and 23 and for the outboard files of containers 12 is conveniently a system of star wheels, such as star wheels 136 and 138 shown in FIG. 4 of U.S. Pat. No. 3,032,944, and described therein. Those star wheels are mounted below and outwardly of the drum 14 and engage the outboard side surfaces of the outboard cans 12 to accurately direct the leading edge of each can 12 into the leading edge of one of the bands 21 and 23 of the carrier strip 20 substantially at the point at which the leading edges of the bands 21 and 23 pass below the upper surface of the cans 12. Those star wheels which are shown in FIG. 7 at 70 accelerate the cans 12 at the point of band engagement slightly faster than the horizontal movement of the conveyor 11.

Figure 6:
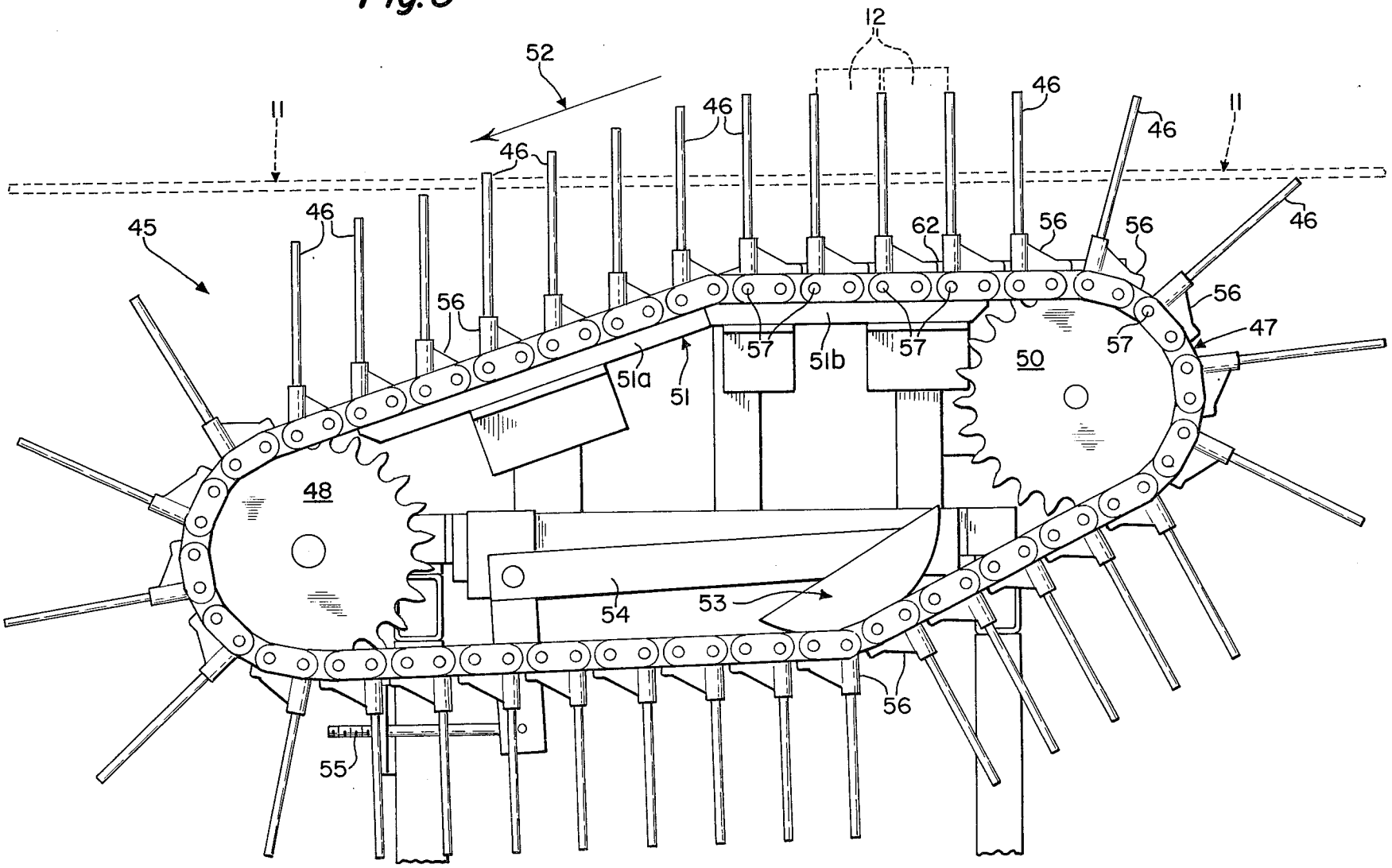
FIG. 6 is an enlarged side elevational view of the guide system of the subject invention as shown in dotted lines in FIG. 1, but viewed from the other side of the machine.

The second arrangement, that for accurately controlling and directing the leading edge of each can 12 in the center file into the leading edge of one of the bands 22 is the mechanism of the subject invention. That center file can control mechanism 45 is shown in dotted lines in FIG. 1, and as shown therein, the mechanism 45 is mounted in the base 10 of the machine generally beneath the work station 13 and includes a series of fingers 46 which are serially moved into and through the work station 13 substantially in a vertical plane offset slightly to one side of a vertical plane through the center of the center file of cans 12. The mechanism 45 is shown in substantial detail in FIG. 6 from the side opposite from that shown in FIG. 1. As shown in FIGS. 2 and 7, the split portions 11a and 11b of the conveyor 11 at the input end of the work station 13 permit the series of fingers 46 to move upwardly between conveyor portions 11a and 11b to achieve interposition with the center file of containers 12. The horizontally disposed, shaped can guides 71, 72, 73 and 74 in cooperation with vertically disposed wall members 75, 76, 77, 78, 79 and 80 guide the three files of containers 12 into the work station 13. As may be seen in FIG. 7, the rearward end of wall 77 and the forward end of wall 78 are spaced-apart to enable the fingers 46 to move upwardly therebetween into interposition with the center file of containers 12. That interposition is accomplished by the wall members 78 and 79, and the guide 73 directing the center file of cans 12 diagonally between the fingers 46 as the containers 12 are moved by the conveyor 11. As further shown in FIG. 7, the slot between the conveyor portions 11a and 11b is offset to one side of a vertical plane through the center line of the center file of containers 12 in the work station 13. By virtue of that offset, any directing force of the fingers 46 on the containers 12 results in a sidewise component of urging movement of the containers 12 against the vertical wall 79. Thus, the movement of each container 12 of the center file of containers 12 through the work station 13 is controlled by the fingers 46 and vertical wall 79, independently of the speed of movement of the conveyor 11. Obviously, if the fingers 46 are moving slower than the conveyor 11, the finger 46 on the leading side of a container 12 will engage the container 12 therebehind retarding the movement of the container 12 through the work station 13 to move at the speed of the finger 46 with the container 12 also being urged against the vertical wall 79. If the fingers 46 are moving faster than the conveyor 11, the finger 46 on the trailing side of a container 12 will urge the container therebefore forwardly at the speed of movement of the finger 46 and with the container 12 being urged against the vertical wall 79.

The center file can control mechanism 45 comprises a continuous roller chain 47 mounted about two sprocket wheels 48 and 50 below the can carrying conveyor 11. Suitable drive means (not shown) rotates one of the sprockets 48 or 50 to continuously move the chain 47 thereabout in a timed relationship to the conveyor 11. The upper flight of the chain 47 is supported upon a chain guide 51 having two sections 51a and 51b. The chain guide 51 is carried upon suitable mounting brackets secured to the frame of the machine, and the section 51b is aligned substantially horizontally while the section 51a is inclined downwardly and forwardly in the direction of movement of the chain 47 as shown by arrow 52 in FIG. 6. A conventional chain tightening mechanism 53 is secured to a bell crank 54 which is pivotally mounted to a frame member of the machine. The chain tightener 53 is urged downwardly against the lower flight of the chain 47 by a threaded stud and nut assembly 55 secured between a frame member of the machine and the bell crank 54.

Figure 10:
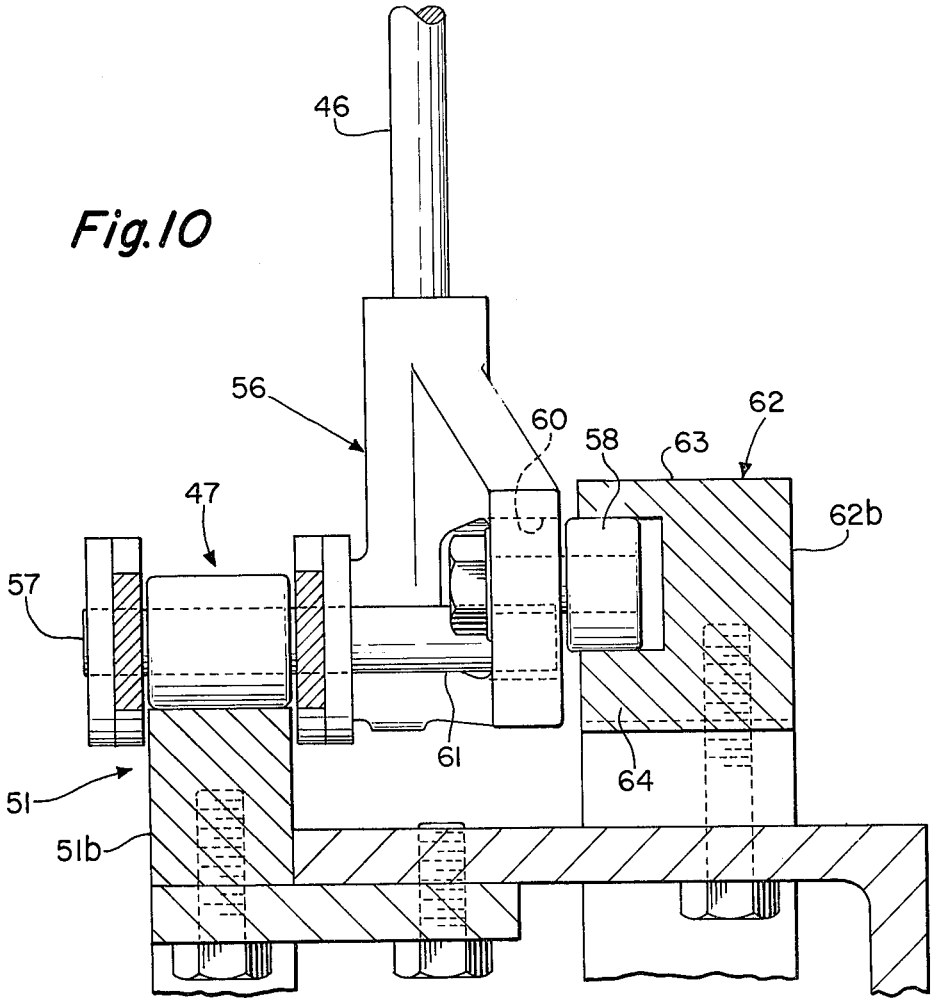
FIG. 10 is a cross-sectional view of a portion of the container control mechanism shown in FIG. 9 and taken substantially along the line 10 — 10 of FIG. 9.

The roller chain 47 carries a plurality of finger brackets 56. Each finger bracket 56 is pivotally carried on one side of the chain 47 by one of the chain pins 57 as may be seen in FIGS. 9 and 10. Each bracket 56 carries a cam roller 58 which extends outwardly from one side of the bracket 56 and is positioned rearwardly of the pin 57, as may be seen in FIG. 9. A slot 60 in each bracket 56 cooperates with an extension of the roller chain pin 61 to permit a certain limited amount of pivoting movement of each bracket 56 about the axis of its supporting pin 57.

Figure 8:
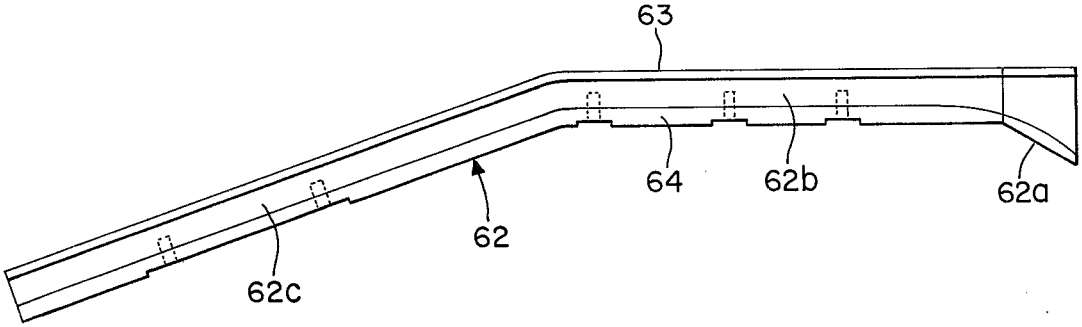
FIG. 8 is a view of the cam track for the finger brackets on the chain of FIG. 6.
Figure 9:
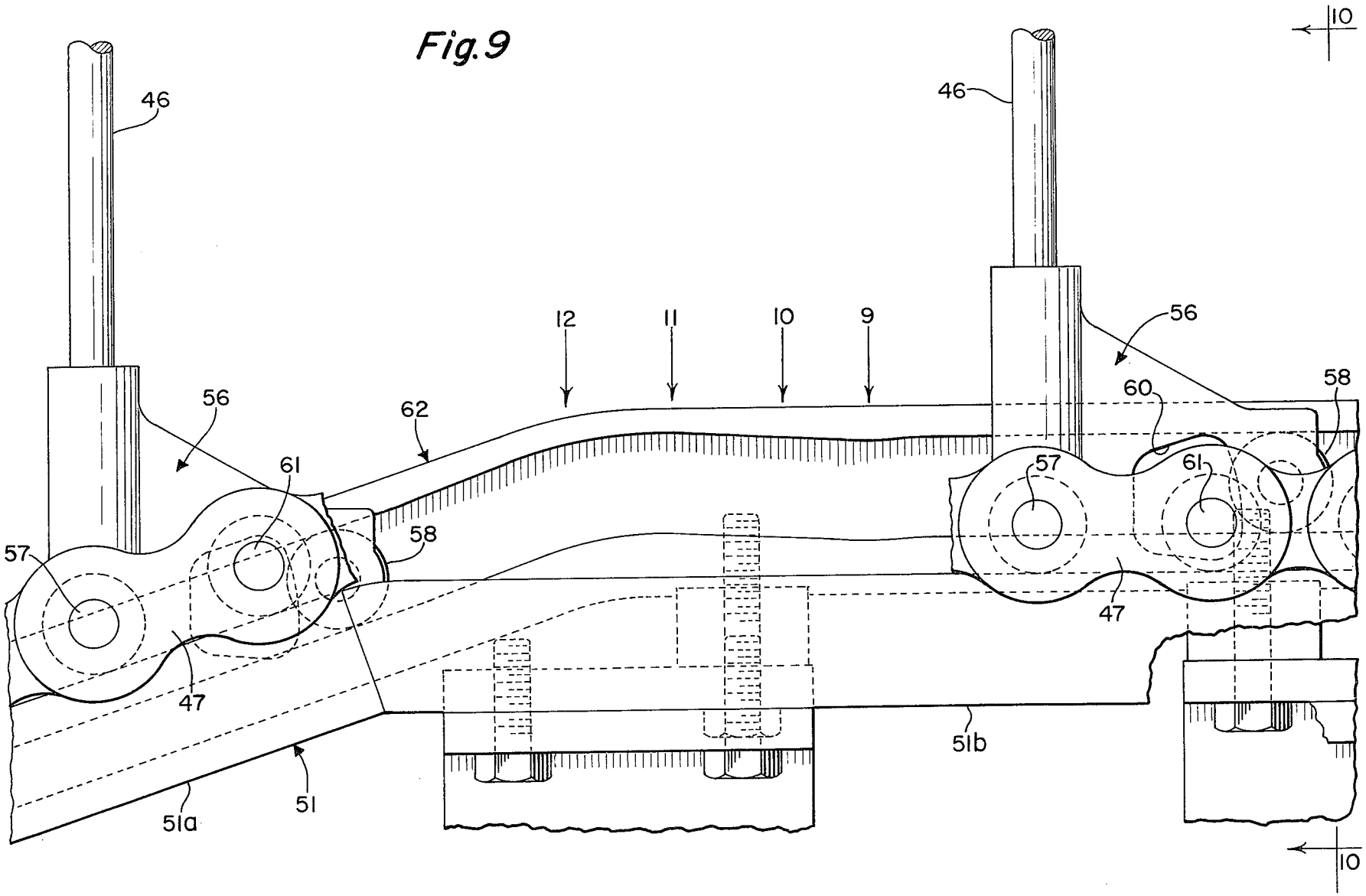
FIG. 9 is an enlarged view of the longitudinally central portion of the cam track of FIG. 8 and further showing a portion of the chain guide for the upper flight of the chain and further showing a small portion of the chain and two finger brackets.
Figure 11:
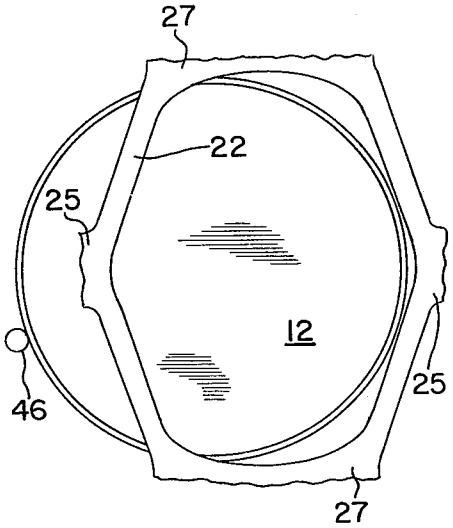
FIG. 11 is a top plan view of one of the carrier bands of the center file of carrier bands as it would substantially appear when viewed downwardly from within the applicating machine when the cam roller of the finger bracket engaging that can is substantially at position 9 as shown in FIG. 9.

When any portion of the chain 47 rotates about the sprocket 50 to become the upper flight of the chain, the rollers 58 on the brackets 56 will enter into the rearward end **62*a* of the cam track 62 shown in FIG. 8. The cam track 62 is behind the upper flight of the chain 47 shown in FIG. 6. Further, an enlarged portion of the cam track 62 is shown in FIG. 9 with the lower edge thereof partially hidden by the chain guide sections 51*a* and 51*b*. In addition to the rearward section 62*a*, the cam track 62 further includes an intermediate section 62*b* which is positioned substantially horizontally beneath the conveyor 11 and parallel to the chain guide section 51*b*. That horizontal section 62*b* is shown in enlarged cross section in FIG. 10. The cam track 62 further includes a forward end section 62*c* which is inclined downwardly and forwardly substantially parallel to the section 51*a* of the chain guide. Each section 62*a*, 62*b* and 62*c* of the cam track 62 includes a pair of vertically spaced-apart upper 63 and lower 64 walls which are respectively disposed above and below each roller 58 of each finger bracket 56 on the upper flight of the chain 47 to control the pivoting movement of each bracket 56 about the pins 57. Each bracket carries a finger 46, as may be seen in FIGS. 6, 9 and 10. As described above, the conveyor 11 is provided with an open slot between the conveyor portions 11*a* and 11*b* so that the fingers 46 on the upper flight of the chain 47 can extend therebetween without interference. When the brackets 56 are adjacent the horizontal section 51*b* of the chain guide 51, the fingers 46 are aligned substantially vertically and to one side of a vertical plane through the center file of cans 12 as may be seen in FIGS. 11 – 14. In that area of horizontal movement of the fingers 46, the brackets 56 and fingers 46 carried thereby are moving at the same speed or slightly faster than the conveyor 11 upon which the cans 12 are carried. Thus, each finger 46 will engage the rearward side of a can 12 and will move the engaged can horizontally forwardly at a speed and with a spacing synchronized to the rotating speed of the drum assembly 14 and the spacing of the stretched bands 22 of the carrier stock 20 so that the leading edge of a can 12 will substantially coincide with the leading edge of the aperture of a band 22 somewhat as shown in FIG. 11 when the leading edge of the band 22 moves below the upper surface of the can 12 as the drum assembly 14** rotates.

When a cam roller upon a bracket 56 reaches the position in the cam track **62*b* indicated by the arrow 9 in FIG. 9, a slight downward movement of the cam roller will occur. This slight downward movement of the cam roller 58 is translated into a slight rearward pivoting of the associated finger 46 to slightly relax or retard the forward movement of the container 12 by the finger 46 at that position. The retardation is in degree roughly 5 thousandths of an inch and tends to ensure that the leading edge of an aperture of a band 22 at that position will be forwardly of the associated can 12 substantially as shown in FIG. 11**.

Figure 13:
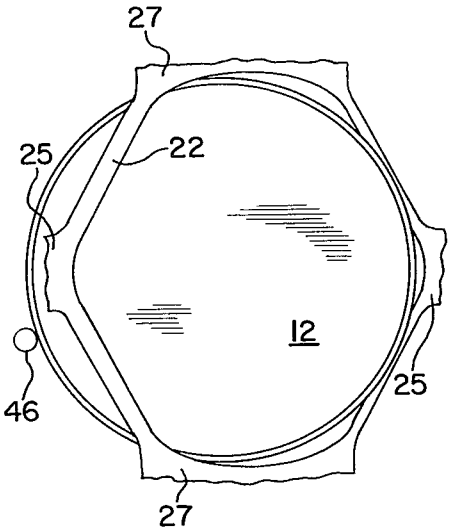
FIG. 13 is a view similar to FIG. 11, but with the cam roller substantially at position 11 in FIG. 9.
Figure 12:
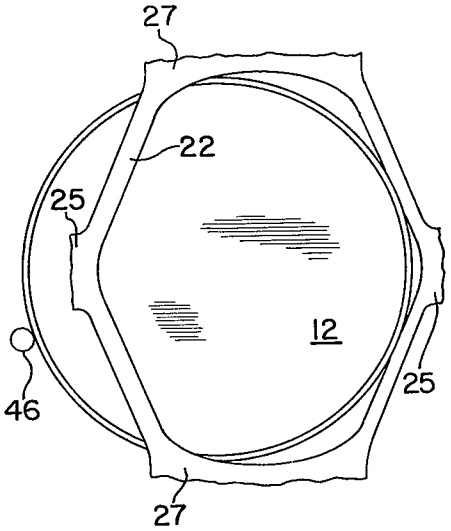
FIG. 12 is a view similar to FIG. 11, but with the cam roller substantially at position 10 in FIG. 9.

After a cam roller 58 passes the position shown by the arrow indicated with the number 9 in FIG. 9, the cam roller moves into the area of the cam track **62*b* indicated by the arrows which are numbered 10 and 11 in FIG. 9. In that area of the cam track 62*b* a cam roller 58 is moved upwardly relative to the supporting surface of the chain guide 51*b* to cause a forwardly pivoting movement of the associated finger 46. That forward pivoting of a finger 46 results in an acceleration or advance in the speed of forward movement of a can 12 on the conveyor 11 and relative to the component of movement of a carrier band 22 on the drum assembly 14 in that direction. That advance or acceleration urges the leading edge of an associated can 12 into stretching engagement with a leading edge of the aperture of an associated band 22 of the carrier stock 20. FIGS. 12 and 13 substantially show that advance or acceleration with FIG. 12 showing the start of the advance and with FIG. 13 showing the maximum advance. The described advance, aids in the high speed application of the carrier bands 22 to the center file of the cans 12**.

Figure 14:
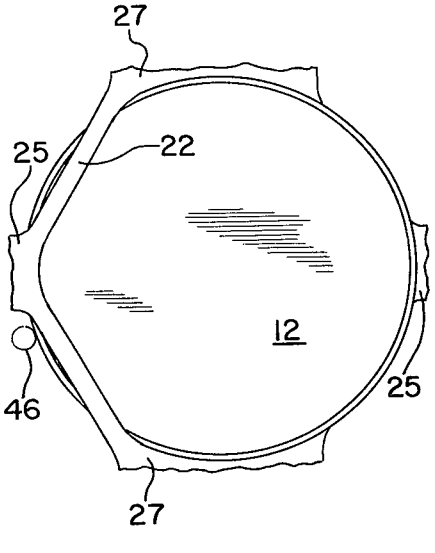
FIG. 14 is a view similar to FIG. 11, but with the cam roller substantially at position 12 in FIG. 9.

When a cam roller 58 reaches the position shown by the arrow indicated with the number 12 in FIG. 9, the associated bracket 56 is starting down the slope of the chain guide **51*a*. In that position a band 22 is approximately as shown in FIG. 14 with the trailing edge of the aperture of the band 22 substantially immediately ready to snap over the trailing edge of the associated can 12 to complete circumferential engagement of that band 22 with its associated can 12**.

After the position shown by the arrow 12 in FIG. 9, the carrier stock 20 is applied to the three files of cans 12 and begins to move on the conveyor 11 forwardly out of the work station 13. Because of the downward slope of the roller chain guide section **51*a* and the corresponding slope of the cam track section 62*c*, the horizontal component of movement of the fingers 46 over that area is less than the speed of movement of the fingers 46 over the horizontal area of movement on the upper flight of the chain 47 with the result that the fingers 46 are moving slower than the conveyor 11, thereby resulting in a speed of the three files of containers 12 with the applied carrier stock 20 which is less than the speed of the containers 12 over the horizontal area of movement on the upper flight of the chain 47 as the fingers 46 move downwardly below the conveyor 11 and thence about the sprocket wheel 48. The three files of containers 12 with the applied carrier stock 20** may then move into a cutoff station such as shown and described in the U.S. Pat. No. 3,991,640 to Schlueter.

Having described the invention it is to be understood that changes can be made in the described embodiment by one skilled in the art within the scope of the hereinafter following claims.

We claim:

1. In an applicating machine for applying a strip carrier stock to a plurality of containers in which at least three continuous and uninterrupted files of containers are continuously moving on a conveyor through a work station in the machine at which work station an applicating mechanism applies the carrier stock over and in an embracing relationship to the upper ends of the at least three files of containers, the carrier stock comprising at least three files of carrier bands integrally interconnected in rank and file and the applicating mechanism continuously moving the bands downwardly and forwardly toward said files of containers in the direction of movement of said files of containers, the improvement of said conveyor being formed with at least one vertically open slot therein, said slot extending horizontally in said work station below and offset to one side of the centerline of a file of intermediate containers between the outboard files of containers, a stationary rail mounted in said work station above said conveyor and between an outboard file of containers and said intermediate file of containers along the side of said intermediate file of containers opposite from said one side of said centerline of said file of intermediate containers, a plurality of fingers, means carrying said fingers comprising a continuous roller chain mounted on a pair of chain sprocket wheels for movement thereabout below said conveyor and in a vertical plane passing through the intermediate file of containers of said three files of containers in said work station, said means carrying said fingers further comprising a plurality of brackets, each of said fingers secured to one of said brackets, one end of each of said brackets being carried on an extending end of one of the roller chain pins, the other end of each of said brackets having a slot therethrough and an adjacent roller chain pin extending into said slot to carry the finger secured thereto outwardly of and generally perpendicular to the linear direction of said roller chain and for limited pivotal movement in said vertical plane on both sides of said perpendicular, guide wall means above said conveyor and the rearward of said pair of chain sprocket wheels for directing said intermediate file of containers from one side of said conveyor diagonally forwardly into interposition with said fingers as said brackets are carried by said roller chain about said rearward chain sprocket wheel to the upper flight of said roller chain, and means for moving said roller chain in the direction of movement of said conveyor, whereby said intermediate file of containers is moved through said work station at the speed of said fingers by the containment of said intermediate file of containers between said fingers and said rail in said work station.

2. In an applicating machine as defined in claim 1, a roller chain supporting member mounted to support the upper flight of said roller chain thereon through said work station, said supporting member being inclined downwardly from a position in said work station substantially after said carrier stock has been applied to said containers, said fingers having length sufficient to maintain contact with said containers over a substantial portion of the travel of said upper flight of roller chain over the downwardly inclined portion of said supporting member.

3. In an applicating machine as defined in claim 2, cam means comprising a cam track mounted in said machine substantially parallel to said supporting member, each of said brackets carrying a cam roller rearwardly of said slot therethrough in the direction of movement of said containers through said work station and each of said cam rollers engaging and moving within said cam track along the upper flight of said roller chain, and said cam track being configured at a position prior to the downwardly inclined portion of said supporting member to cam each cam roller passing through said position to pivot the associated bracket about the axis of said one of the roller chain pins carrying said one end of each of said brackets to momentarily forwardly pivot the associated finger to momentarily forwardly accelerate the container engaged by said associated finger.

* * * * *